US007537556B2

(12) United States Patent
Bober

(10) Patent No.: US 7,537,556 B2
(45) Date of Patent: May 26, 2009

(54) HIGH CAPACITY KNIFE FOLDING SYSTEM

(75) Inventor: Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 42 days.

(21) Appl. No.: 11/977,576

(22) Filed: Oct. 25, 2007

(65) Prior Publication Data

US 2009/0111673 A1 Apr. 30, 2009

(51) Int. Cl.
*B65H 45/04* (2006.01)

(52) U.S. Cl. ..... 493/23

(58) Field of Classification Search ..... 493/405, 493/419, 424, 442–445, 446–449, 454–455, 493/457, 434–435, 8, 23, 25, 29, 34
See application file for complete search history.

(56) References Cited

U.S. PATENT DOCUMENTS 4,643,705 A * 2/1987 Bober ..... 493/444
5,080,339 A * 1/1992 Hirahara ..... 270/21.1
5,147,276 A * 9/1992 Stab ..... 493/444
5,169,376 A * 12/1992 Ries et al. ..... 493/445
5,242,364 A * 9/1993 Lehmann ..... 493/8
5,738,620 A * 4/1998 Ebner et al. ..... 493/445
5,937,757 A * 8/1999 Jackson et al. ..... 101/232
6,042,529 A * 3/2000 Hubler et al. ..... 493/434
6,086,522 A * 7/2000 Hechler ..... 493/23
6,276,677 B1 * 8/2001 Hommochi et al. ..... 270/32
6,475,129 B1 * 11/2002 Lehmann ..... 493/421
6,592,506 B1 * 7/2003 Lyga ..... 493/424
6,641,514 B1 * 11/2003 Hechler ..... 493/8
6,730,010 B2 * 5/2004 Yamakawa et al. ..... 493/267
7,220,223 B2 * 5/2007 Erdt et al. ..... 493/25

* cited by examiner

*Primary Examiner*—Christopher Harmon
(74) *Attorney, Agent, or Firm*—James J Ralabate

(57) ABSTRACT

This invention provides a paper folding assembly where the thickness of the paper set stack is directly measured and will automatically determine the size of a gap located between two folder cylinders. A knife will push the set between the adjusted gap once it has been adjusted for the thickness of the set. The knife and driven nip rollers are positioned above this gap and are conveniently pushed into the gap to provide the set fold, for example, to make a booklet.

4 Claims, 4 Drawing Sheets

TRADITIONAL KNIFE FOLDER

USP # 4,643,705

HIGH CAPACITY KNIFE FOLDING SYSTEM

This invention involves an assembly for making signature booklets, and more specifically, to an improved knife folder system.

BACKGROUND

While the present invention involving a paper folding operation can be effectively used in a plurality of different media printing or booklet-making configurations, it will be described for clarity as used in electrostatic marking systems such as electrophotography.

By way of background, in marking systems such as Xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to a final support material such as paper and the toner image is fixed thereto to form a permanent record corresponding to the original.

After fusing of the toner image onto the paper substrate, the paper is either moved to a collection tray where it is removed from the marking apparatus, or it may be transferred to a finishing station for further processing. At the finishing station, the copies may be compiled into sets, or may be stapled, or may be directed to a booklet maker where sets are compiled, saddle stapled and folded to make booklets such as Signature Booklets. "Signature Booklets" are made from multiple sheets of paper or similar printable media where up to four images or pages are placed on each sheet [two per side] such that when the sets are compiled, stapled and folded in half, that the images appear in proper page order. The signature booklet may employ an outer cover sheet compiled during the set making process. The cover is often a heavier paper basis weight and or rougher texture than the ordinary pages in the booklet. The basis of embodiments of this invention involve a knife folder structure useful to provide more precise and more reliable folding operations, especially when creating thicker booklets. Some Signature Booklet Makers (SBM) can create from 8 to 200 imaged page signature booklets, requiring 2 to 50 signature sheets per booklet. For example, the following Signature Booklet Maker Finishers, typical of office or light production reprographic equipment are capable of producing Signature Booklets sizes as indicated:

| Manufacturer | SBM Finisher | Sheets/Set | Pages/Booklet |
|---|---|---|---|
| Xerox | MFF, HCSS, HVF | 15 | 60 |
| Ricoh | BK5000 | 15 | 60 |
| Canon | V-2 | 20 | 80 |
| Ricoh | BK5010 | 30 | 120 |
| Konica-Minolta | SD-501 | 50 | 200 |

Therefore, the folder assembly of the present invention must be able to accommodate sets comprising at least 2 and up to 50 signature sheets, and even more for eventual future faster systems. The embodiments of the disclosed invention provide a system which directly measures the thickness of the set to be folded at the folding location and then automatically adjusts the gap between the folding cylinders to reliably accommodate these varied set thickness.

In U.S. Pat. No. 4,643,705 by the same inventor and assignee as the presently described invention, an improved knife folder is defined and claimed. The present embodiments involve a further refinement and substantial improvements over this prior art patent. The disclosure of U.S. Pat. No. 4,643,705 is incorporated herein by reference.

Signature Booklet Makers (SBM's) of the prior art accept 4-up signature sheets (2+2 images per signature), compile individual sheets into a set, saddle staple the sheets and then fold the stapled sets to make signature booklets. Optional face trimming shears off the shingled thumb edge and produces a high quality customer-ready finished product. The folding in the prior art of the stapled set is typically accomplished by a knife folder as follows:

- A blade is centered over a cylindrical folder nip
- The stapled set is staged and centered over the cylindrical nip
- The blade is actuated
- The blade bends the set
- Friction between the cover sheet and the folding cylinders drives the set into the fold nip
- The nip acquires the set and folds it along the staple axis.

One typical prior art failure mode with SMB knife folders is the "sucking" or tearing of the front cover or outer most sheet off of the set. This occurs when the drive forces on the cover sufficiently exceed the drive forces on the balance of the set.

Another prior art failure mode occurs when the set is not acquired symmetrically and the staple axis is mispositioned relative to the "fold line" (i.e. the right/left margins). This increases the level of shingling and shifts image registration relative to the fold line. Both of these failures can be related to the sheet to sheet interfacial forces or stresses (level and uniformity) as the set is acquired by the knife folder cylinder nip.

The market place's growing desire for thicker booklets is only constrained by the machinery's ability to produce quality booklets in a compact, cost effective module.

SUMMARY

Embodiments of the present invention describe a method to increase the capacity of a Signature Booklet Maker. This concept improves on Xerox U.S. Pat. No. 4,643,705. In that patent, a pair of driven nip rolls, which are attached to the folder knife, is used to pinch the set (from top and bottom) between the driven pinch rollers and cylindrical (folding) rollers. A typical failure of the current set folding technique is the tearing off of the front cover due to an imbalance of the drive forces on the cover with respect to the rest of the set. This becomes more problematic as the set thickness or booklet size increases. This invention improves significantly on the patent by directly measuring the set thickness during the closing action of the rollers. This measurement is used to determine, and mechanically set, the proper gap between the cylindrical creasing rollers. By setting this gap based on set thickness, the stresses on the cover sheet can be lowered and damage to the cover avoided. The exact relationship between set thickness and fold cylinder gap can be determined experimentally or via analysis. The cylinder gap will be optimized and customized for each of the various set thicknesses. A more robust folder is the result.

In embodiments of the present invention, a folding station is provided having a sheet support to receive and support stapled and compiled sheet sets. An adjustable stop is located at the far end (away from the feed in or set entry) of the support; the sheets coming into or onto the support are stopped as they align against this fixed or adjustable guide or stop. Above the support are at least two driven nip rollers (more depending on sheet width and roller width) that are attached to the knife folder blade to be movable up and down by any conventional means. The blade is located between said nip rollers and is located centrally over the nip between two the folding cylinders that are located below the support. The incoming stapled set is centered precisely over the folding cylinder nip. The knife assembly is moved downwardly until travel is stopped by the nip rollers clamping of the stapled set against the folding cylinders. The knife protrudes below the nip rollers and the action of the knife tip against the stapled set starts to buckle the sheets and direct them into a folding nip between the folding cylinders. The contact between the driven nip rollers and driven folding cylinders having a set therebetween causes the sheet set to continue to gently buckle down into the open folding nip between the folding cylinders with a uniform velocity throughout the thickness of the set.

While-in the prior art of U.S. Pat. No. 4,643,705, the folding cylinders were loaded against each other in intimate contact a variable gap based on the measured stapled thickness is incorporated in the present invention. This is important to eliminate or minimize stress on the stapled set as it enters the folding nip and thereby reduce or eliminate distortion of the fold and tearing of the paper set including the set cover. This variable gap between the folding cylinders is directly related to the set thickness between the nip rollers and the folding cylinders. This thickness is directly measured by how far the clamp mechanism (the nip rolls) closes down on the set. Once the nip rolls are moved down against the top of the set, this effectively measures the thickness of the set. In one embodiment, a sensor or gap adjuster can convey this thickness to a controller that will automatically widen or narrow the gap between the folder cylinders in accordance with the set thickness. In other embodiments suitable mechanical gap adjusting means (including but not limited to gears, linkage mechanisms, cams, wedges, etc) are used in proportion to the set thickness. This provides a high capacity-low stress knife folder assembly since there is less resistance and stress on the sheets in the stapled set when forcing a thicker set into this wider gap, and it is less likely that the folding operation will cause tears in the cover or other sheets in the set when in the folding nip. This is most important with thicker set sizes.

The gap adjuster used in all embodiments of this invention include electro-mechanical means (like a sensor and a servo motor) or purely mechanical adjusters (like cams, rack and pinions, 4 bar linkages and mixtures threof, to adjust the gap "G" band on the directly measured set thicknes "t".

All of the "gap adjusters" will be defined in drawings and the claims as—. . . "mechanical adjusters, electrical adjusters and mixtures thereof." Also a controller is included in the term "gap adjuster".

DETAILED DISCUSSION OF DRAWINGS AND PREFERRED EMBODIMENTS

Figure 1:
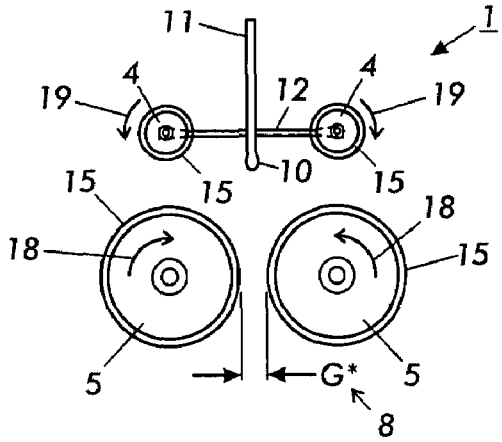
FIG. 1 is a partial side view of the paper folding assembly of an embodiment of this invention prior to the entrance of a set of stapled sheets to be folded therein.
Figure 2:
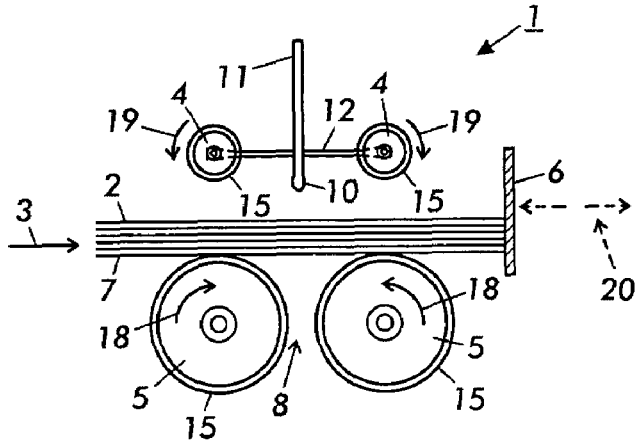
FIG. 2 is the assembly of FIG. 1 once the paper sets have arrived to be folded.
Figure 3:
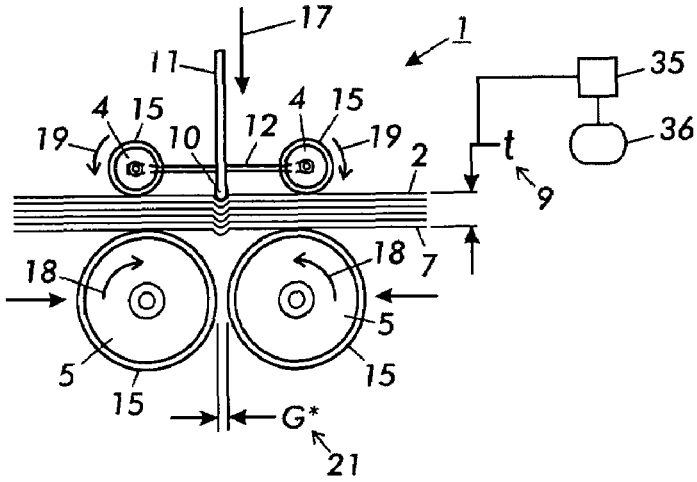
FIG. 3 is the assembly of FIG. 2 once the knife folder has begun its downward motion and the nip rollers have clamped the stapled set against the folding cylinders.

In FIG. 1 an embodiment of the present invention is shown in a side view where the assembly 1 is ready to accept a stapled set 2 from the Booklet Maker Compiler Tray 3 (See element 2 of FIG. 2). Suitable set transport means drive the stapled set in the direction 22 indicated to move the stapled set 2 into a space between nip rollers 4 and folding cylinders 5. Once the stapled set 2 enters the space, it will be moved until it hits an adjustable set stop 6 to center the staple axis precisely over the folding cylinder nip. The arrows 20 indicate the direction of adjustable sheet stop 6. The surface speeds of the nip rollers 4 and folding cylinders 5 are nominally the same. The cover sheet 7 is located at the bottom of the set stack 2, closest to the folding cylinders 5. The action of the driven nip rollers 4 prevents the stapled spine from being put in tension by the action of the folding cylinders 5 on the cover 7 trying to pull the rest of the set 2 by the staples into the folding cylinder nip 8. The adjusted gap 21 (as shown in FIG. 3) is related to the stapled set thickness (t) 9 and can vary with each run depending upon the thickness (t) 9 of each stapled set and total number of sheets in the stapled set 2. The arrows 18 indicate the drive direction of the folding cylinders 5, and the arrows 19 indicate the drive direction of nip rollers 4.

In FIGS. 2 and 3, as stapled the set 2 enters the space between the nip rollers 4 and folding cylinders 8 from the Booklet Maker Compiler 3, they are moved against a registration stop 6, and the upper nip roller assembly 12 with knife 11 are moved down onto the set 2. The set thickness (t) 9 is directly measured by how far the clamp mechanism 12 closes on the set 2 against the folding cylinders 5. This is an important aspect of the present invention, since the thicker the paper set 2, the wider the adjusted gap 21 becomes, and this will provide more uniform resistance and less stress on the booklet spine, especially with thicker booklets than compliantly loaded contact of the traditional knife folder system. Software controller 36 and sensors 35 or suitable mechanical means may be used to automatically set the initial gap 8 to the proper adjusted gap or width 21. This embodiment directly measures the set thickness t–9 and mechanically or electronically sets the proper gap 21 between the cylindrical creasing rollers 5.

Figure 4:
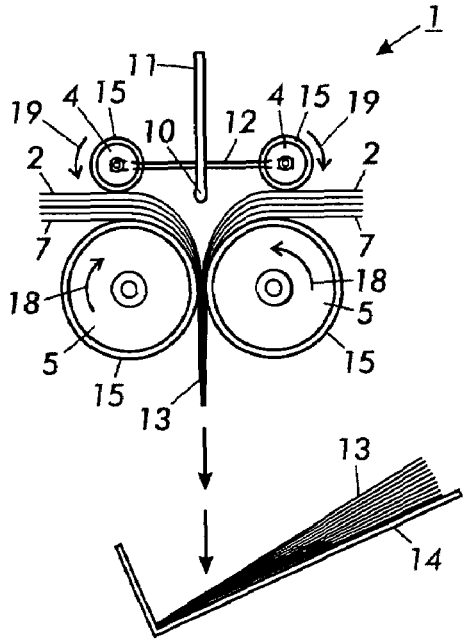
FIG. 4 is the assembly of FIG. 3 after the knife has folded the stapled set and the folded set is moving toward the set catch tray.

A sensor 35 can convey this thickness to a controller 36 that will automatically widen (or narrow) the normal gap 8 between the folding cylinders 5 in accordance with the set thickness as measured. The sensor 35 and controller 36 will be defined herein as the "gap adjuster." The sensor can be a mechanical, optical or electrical sensor. The controller includes mechanical adjusters, electrical adjusters and mixtures thereof. The knife 11 deflects the stapled set 2 toward the adjusted folding cylinder nip or adjusted gap 21, creating a central buckle. The arrow 17 in FIG. 3 indicates the direction of knife 11 actuation. The combined drive effects of the upper driven nip rolls 4 and the driven folding cylinders 5 force the set 2 into the initial folding nip 8 which has been closed to a compliantly loaded gap or nip (G*) 21 by the action of the upper clamp mechanism or assembly 12 closing on the stapled set 2. In an embodiment it can be assumed that a relationship between t and G* will exist whereby $G^*=(k)\times(t^n)$ with the value of $k<1.0$ where the coefficient (k) and exponent (n) are determined empirically or by analysis. In previous embodiments of knife folding systems, the compliant loading of the folding cylinders 5 is established to simultaneously provide a crisp fold AND to accommodate varying stapled set thicknesses. In this novel embodiment, the stapled set thickness dependent adjusted gap G* 21 accommodates a very wide range of set thicknesses while the design parameters (k), (n) and the folding cylinder compliance control the fold crispness. This process continuously proceeds and in FIG. 4, the crisply folded booklet 23 is ejected from the knife folder into a catch tray 14 where it is removed from the folder assembly 1. Knife tip 10 is suitably formed based on traditional practice and it should not tear the set 2 during folding operation.

The surface velocity of the driven nip rollers 4 is never less that the surface velocity of the folding cylinders 5. Since these are driving elements, they should be coated with a high coefficient of friction (CoF) elastomeric material 15. It is important to ensure that the CoF of the driven nip rollers 4 is at least as high as the CoF of the folding cylinders 5 to insure that the driven nip rollers 4 never slip on the stapled set 2. Once in the initial nip 8, both sides of the stapled set 2 will have equal velocities. It is also important to prevent the transmission of any shearing forces through the sheet to sheet interfaces of the stapled set 2 in order to prevent distortion or ripping of the stapled spine.

Figure 5:
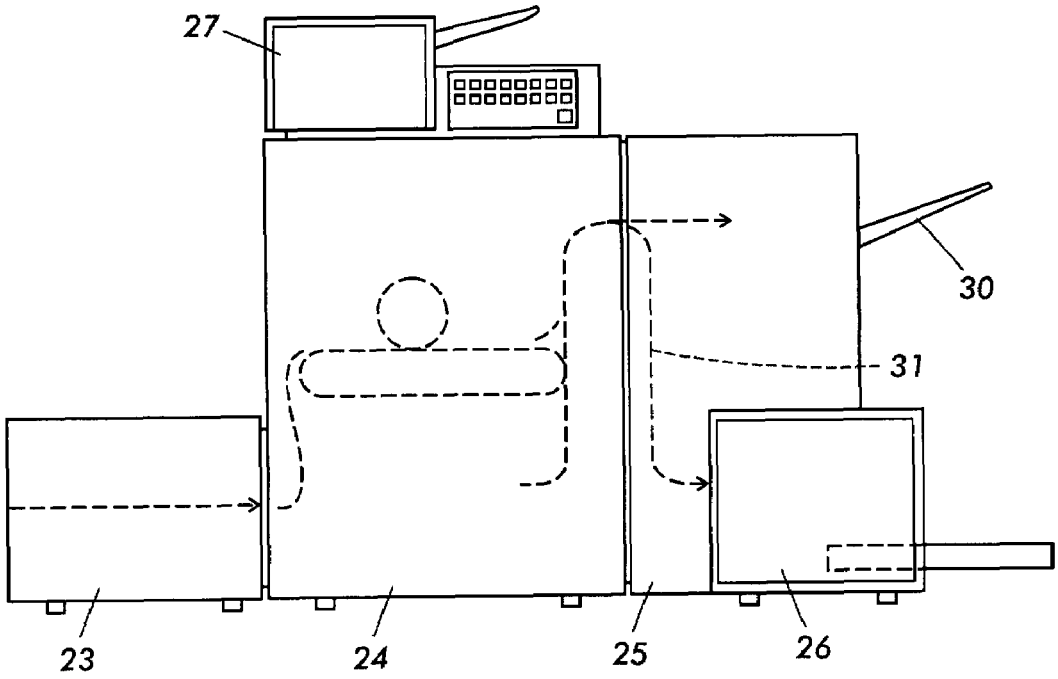
FIG. 5 is a flow diagram showing the paper path through a printing or marking and finishing system.
Figure 6:
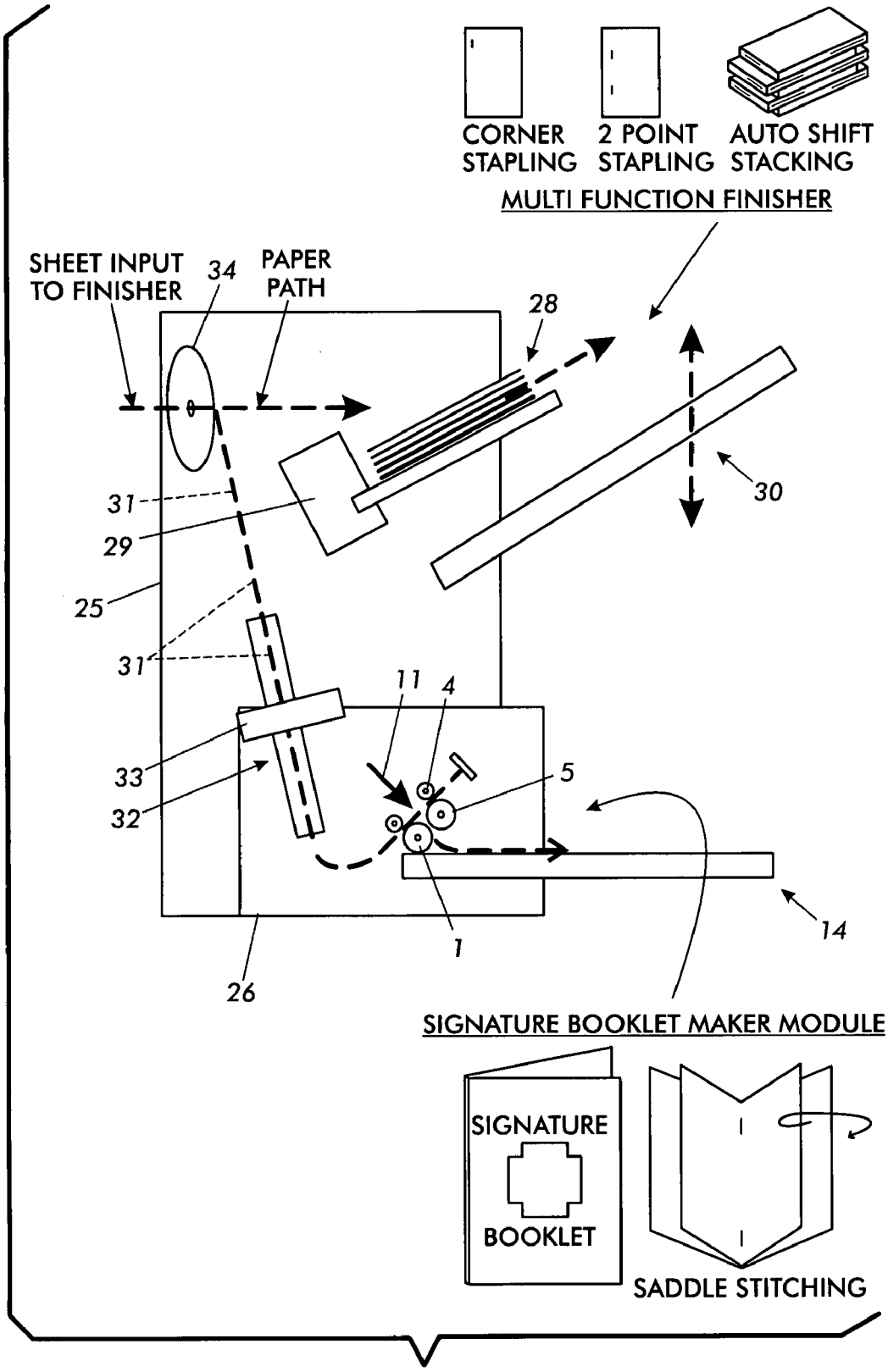
FIG. 6 is a flow diagram showing specifics of the multi-function finisher [MFF] module useful in an embodiment of the present invention.

In FIG. 5 the flow of a paper or substrate through a marking system is depicted as it is fed from a paper feeder 23 into a copy or print engine 24 such as an electrostatic marking system). The document to be reproduced is scanned at the document handler and scanner 27. Once the printing process in print engine 24 is completed (i.e. in an electrostatic print engine the image is exposed, developed, transferred and fixed to the substrate), the paper enters the multifunction finisher module 25 as single sheets. The individual sheets are hole punched at punch 34 (see FIG. 6) if this feature is selected. The sheets proceed to a compiler tray 28 to be later compiled into a registered set. The paper set is stapled at stapler 29 if this feature is selected; if not, the paper goes directly to an output stacker tray 30 and out of the system, If signature booklets are to be produced, as they upon entering the MFF 25, the individual sheets are are diverted and directed by conventional means into the signature booklet maker [SBM] media path 31 for processing. In FIG. 6 a flow diagram of an embodiment of a signature booklet maker or SBM module used in the present invention is shown. Here the SBM paper path 31 conveys the individual sheets to the SBM compiler tray 32 to be compiled into a registered set. The booklet is saddle stitched (2 staples along the center of the sheet) by saddle stitch head or heads 33, and the stapled set is ejected into the folder unit 1 of the signature booklet maker or folding module 26. The knife folder assembly 1 folds the booklet in half (as shown in FIGS. 1-4), and the folded booklet 13 is ejected into the SBM output tray 14. The specifics of knife folder assembly 1 are described in FIGS. 1-4.

Figure 7:
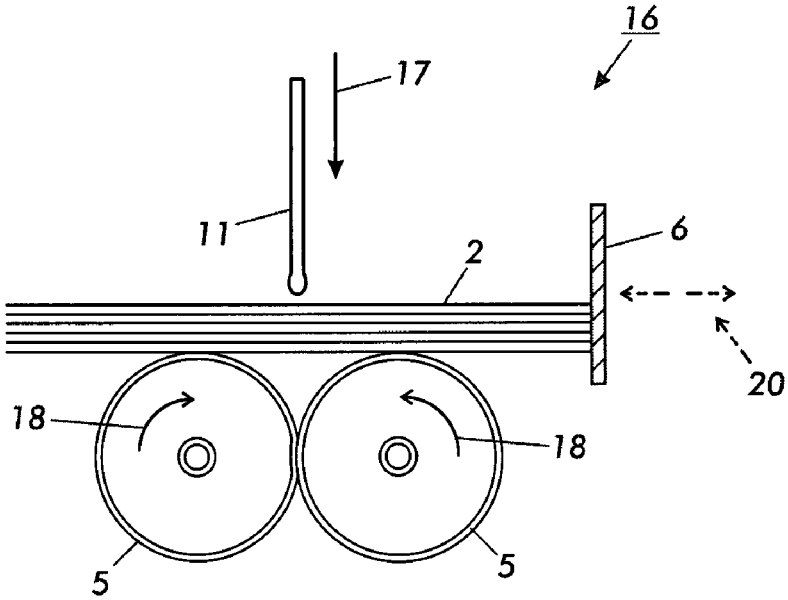
FIG. 7 PRIOR ART
FIG. 7 is a side view of a traditional prior art knife folder.
Figure 8:
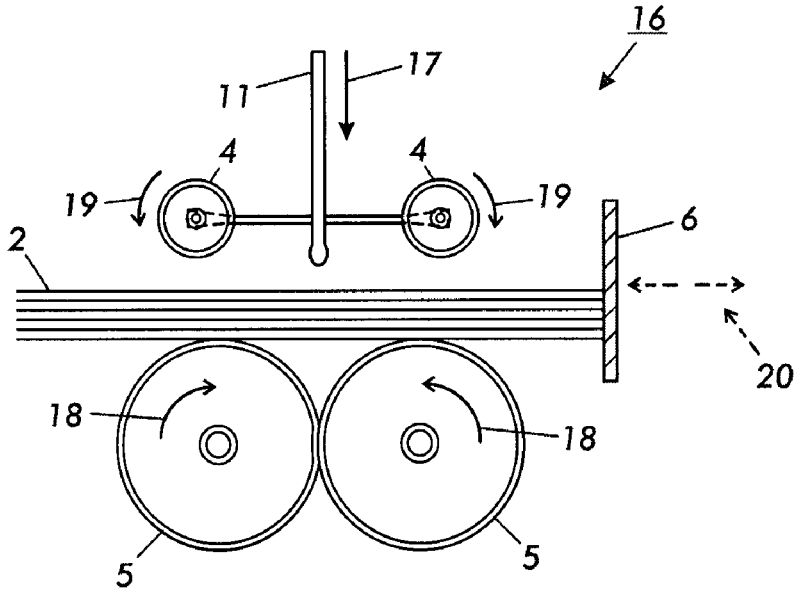
FIG. 8 PRIOR ART
FIG. 8 is a side view of a knife folder described in prior art system of U.S. Pat. No. 4,643,705.

In the prior art assemblies of FIGS. 7 and 8, a traditional assembly 16 is shown in FIG. 7, and in FIG. 8 the assembly of U.S. Pat. No. 4,643,705 is shown. In both assemblies of FIGS. 7 and 8, significantly more tearing of the set 2 can occur, especially with thicker sets. This is compared to the high capacity/low stress knife folder 1 of the present invention.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A paper folding assembly adapted to receive paper sets after they have been marked, compiled and saddle stitched, said assembly comprising:

an upper clamp mechanism, at least two folding cylinders located below said upper clamp mechanisms, gap adjusters comprising a sensor and a controller and a space between said upper clamp mechanism and said folding cylinders, said space adapted to receive said sets after they have been marked and processed a gap or nip located between said folding cylinders, said upper clamp mechanism comprising at least two driven nip rollers with a folding blade or knife there between, said upper clamp mechanism configured to move downwardly to permit said driven nip rollers and said knife to contact an upper surface of said set and configured thereby to directly measure a thickness of said set by a clamping action of said upper clamp mechanism, once said thickness is measured by said upper clamp mechanism and said thickness is conveyed to said gap adjusters, said gap adjusters are configured to continuously alter said gap or nip in accordance with said thickness and to accommodate said set as it is deflected downwardly by an action of said knife to centrally fold said set between said folding cylinders.

2. The assembly of claim 1 wherein said knife and upper clamp mechanism is enabled to push down on said set toward said nip, creating thereby a central buckle in said set, and configured to push said buckled set to an exit from said assembly.

3. The assembly of claim 1 wherein said driven nip rollers and said driven folding cylinders each comprise an outer elastomeric surface.

4. The assembly of claim 1 having a set entrance enabled to receive sets after they are processed and stapled, and having on an opposite end an adjustable set stop configured to properly align said set in said space between said nip rollers and said folding cylinders.

* * * * *